US005533528A

United States Patent [19]

Wallace et al.

[11] Patent Number: 5,533,528

[45] Date of Patent: Jul. 9, 1996

[54] METHOD AND APPARATUS FOR ELEVATING TOBACCO TEMPERATURE

[75] Inventors: Ronald Wallace, Cheltenham; Henry Goldberg, Caulfield South; James Mitchell, Knoxfield; Harald Grosser, Boronia, all of Australia

[73] Assignee: Philip Morris Incorporated, New York, N.Y.

[21] Appl. No.: 175,990

[22] Filed: Dec. 30, 1993

[30] Foreign Application Priority Data

Dec. 31, 1992 [AU] Australia ..... PL6631

[51] Int. Cl.[6] ..... A24B 3/18

[52] U.S. Cl. ..... 131/304; 131/108

[58] Field of Search ..... 131/290, 296, 131/304, 108

[56] References Cited

U.S. PATENT DOCUMENTS

| | | | |
|---|---|---|---|
| 1,785,822 | 12/1930 | Snyder . | |
| 2,737,955 | 3/1956 | Rieggar . | |
| 2,747,581 | 5/1956 | Granstedt . | |
| 3,057,361 | 10/1962 | Respess . | |
| 3,095,883 | 7/1963 | Morris . | |
| 3,664,351 | 5/1972 | Russell . | |
| 3,773,055 | 11/1973 | Stungis . | |
| 3,974,839 | 8/1976 | Wochnowski et al. | 131/304 |
| 4,333,482 | 6/1982 | Banyasz . | |
| 4,488,562 | 12/1984 | Remington . | |
| 4,777,966 | 10/1988 | Belvederi . | |
| 4,844,101 | 7/1989 | Hirsch et al. | 131/296 |
| 4,856,539 | 8/1989 | Lorenzen . | |
| 4,867,180 | 9/1989 | Brackmann et al. | 131/108 X |
| 4,966,170 | 10/1990 | Keritsis . | |
| 5,095,923 | 3/1992 | Kramer | 131/296 |

FOREIGN PATENT DOCUMENTS

| | | |
|---|---|---|
| 560878 | 10/1932 | Germany . |
| 903436 | 2/1954 | Germany . |
| 2211520 | 9/1973 | Germany . |
| 2183443 | 6/1987 | United Kingdom . |

*Primary Examiner*—Jennifer Bahr

*Attorney, Agent, or Firm*—Kevin D. Osborne; James E. Schardt; Charles E. B. Glenn

[57] ABSTRACT

Cigarettes are formed from tobacco filler which is at a temperature in excess of approximately 35° Celsius and having an elevated moisture content. For example, particles of tobacco filler having an elevated moisture content of approximately 13.5% to approximately 17% are heated by being exposed to a source of heat having a temperature of between approximately 35° and approximately 60° Celsius before being formed into tobacco rods. Preferably a temperature range of between approximately 43° and approximately 52° Celsius is employed. The heating source can be selected from infrared radiation sources, hot water jackets, heating coils, microwave radiation sources or air heated by any one or more of the foregoing. The heating process can take place during the acceleration of the tobacco filler particles from the distributor up to the permeable rod conveyor belt or from the tobacco feeding system supplying the distributor.

52 Claims, 4 Drawing Sheets

30
42
10
36
32
26
38
34
54
62
58
70
60
64
40
68

44
46
66
56
52
48
68
54
50
34
10
58

METHOD AND APPARATUS FOR ELEVATING TOBACCO TEMPERATURE

BACKGROUND OF THE INVENTION

1. Technical Field of the Invention

This invention relates to the processing of cigarette tobacco and in particular to the making of cigarettes with reduced packing density without significant loss of firmness using elevated temperatures.

2. Discussion of the Related Art

In the manufacture of cigarettes, as a rule, pneumatic conveying systems are used to transport the cut tobacco filler to the cigarette maker. An air lock at the entrance to the cigarette maker is used to separate the tobacco from the driving air stream, with the tobacco dropping out of the air lock into a hopper. The hopper is equipped with a mechanism to form a uniform tobacco flow, open out the bulk tobacco and generate single fibers, strands, or particles and to eliminate foreign parts and stems. Generally the tobacco is fed in small portions into a reservoir from which a steep angle conveyer belt armed with needles or spikes continuously feeds the tobacco into a bulking chute. A level sensor in combination with a speed control of the steep-angle conveyer belt keeps the level in the hopper constant. At the downstream end of the chute is a discharge roller armed with needles. This roller, or carded drum, picks up the tobacco at a uniform rate, generating a continuous flow of tobacco. A relatively fast rotating picker-roller then combs the tobacco out of the carded drum and projects it into a fast moving air stream belt. This leads substantially to a desirable distribution of single tobacco particles, necessary for the subsequent separation of winnowers, which are generally veins and stems of the tobacco leaf, and for the formation of a relatively uniform tobacco rod. In some machines a rotating collector tube supports the upward acceleration of the fibers. During this transport and heavy particle separation process some degradation of tobacco particles occurs, leading to a loss in quality of resulting cigarettes. The tobacco rod is formed by a narrow perforated conveyor belt of about eight to ten millimeters in width moving quickly at right angles to the direction of pneumatic conveyance. Degradation in cigarette making machines occurs mostly in the elevator conveyor, carding drums and picker winnower assemblies.

Characteristics of cigarettes which are affected by the tobacco are generally considered to include (a) smoking flavor, (b) occurrences of spotting, (c) firmness of the tobacco rod, (d) collapse during smoking, (e) cut strength, and (f) degree of end fallout. Characteristics, or attributes, (c) to (f) are purely physical and normally can be predicted with a high degree of confidence by four properties of the tobacco rod. Those properties are (i) tobacco packing density, (ii) blend filling power, (iii) level and type of add-backs, and (iv) particle size distribution.

The fragility of cigarettes is closely related to the packing density of the tobacco and to particle size. Reduction of the packing density using current manufacturing methods has not been satisfactorily achieved as the resulting cigarettes tend to be too fragile leading to significant handling losses. Further, the tobacco particle size normally found in cigarettes produced by current manufacturing methods is generally well below that which would produce optimum quality cigarettes. There are several reasons for this, including (A) the size of the threshed lamina, (B) the primary processing, (C) the handling of the cut filler, and (D) degradation of tobacco particles in the cigarette making machine.

OBJECTS OF THE INVENTION

It is an object of the present invention to provide an improvement in the cigarette making process to reduce tobacco degradation.

It is also an object of the present invention to provide a cigarette making process which results in cigarettes with reduced packing density without significant loss of firmness.

SUMMARY OF THE INVENTION

According to this invention there is provided an improvement in the making of cigarettes, the improvement comprising the forming of cigarettes from tobacco filler which is at a temperature in excess of approximately 35° Celsius and having an elevated moisture content. According to one aspect of the invention, particles of tobacco filler having a moisture content greater than the conventional moisture content of approximately 12.4%, e.g., between approximately 13.5% and approximately 17%, are heated by being exposed to a source of heat having a temperature of between approximately 35° and approximately 60° Celsius before being formed into tobacco rods. Preferably a temperature range of between approximately 43° and approximately 52° Celsius is employed. The heating source may be selected from infrared radiation sources, hot water jackets, heating coils, microwave radiation sources or air heated by any one or more of the foregoing. The heating process may take place during the acceleration of the tobacco filler particles from the distributor up to the permeable rod conveyor belt or from the tobacco feeding system supplying the distributor.

According to another aspect of the invention there is provided an improved cigarette making machine wherein the improvement comprises the provision of means to heat tobacco filler particles prior to the making of cigarettes. As previously disclosed, the heating means may comprise or may be selected from infrared radiation sources, hot water jackets, heating coils, microwave radiation sources or air heated by any one or more of the foregoing. Preferably the heating means is heated air fed into the pneumatic conveying system either prior to entry of the tobacco filler into the cigarette maker or prior to the making of the tobacco rod.

BRIEF DESCRIPTION OF THE DRAWINGS

So that the invention may be more clearly understood reference is made to the accompanying non-limitative drawings in which.

DESCRIPTION OF PREFERRED EMBODIMENT OF THE INVENTION

Figure 1:
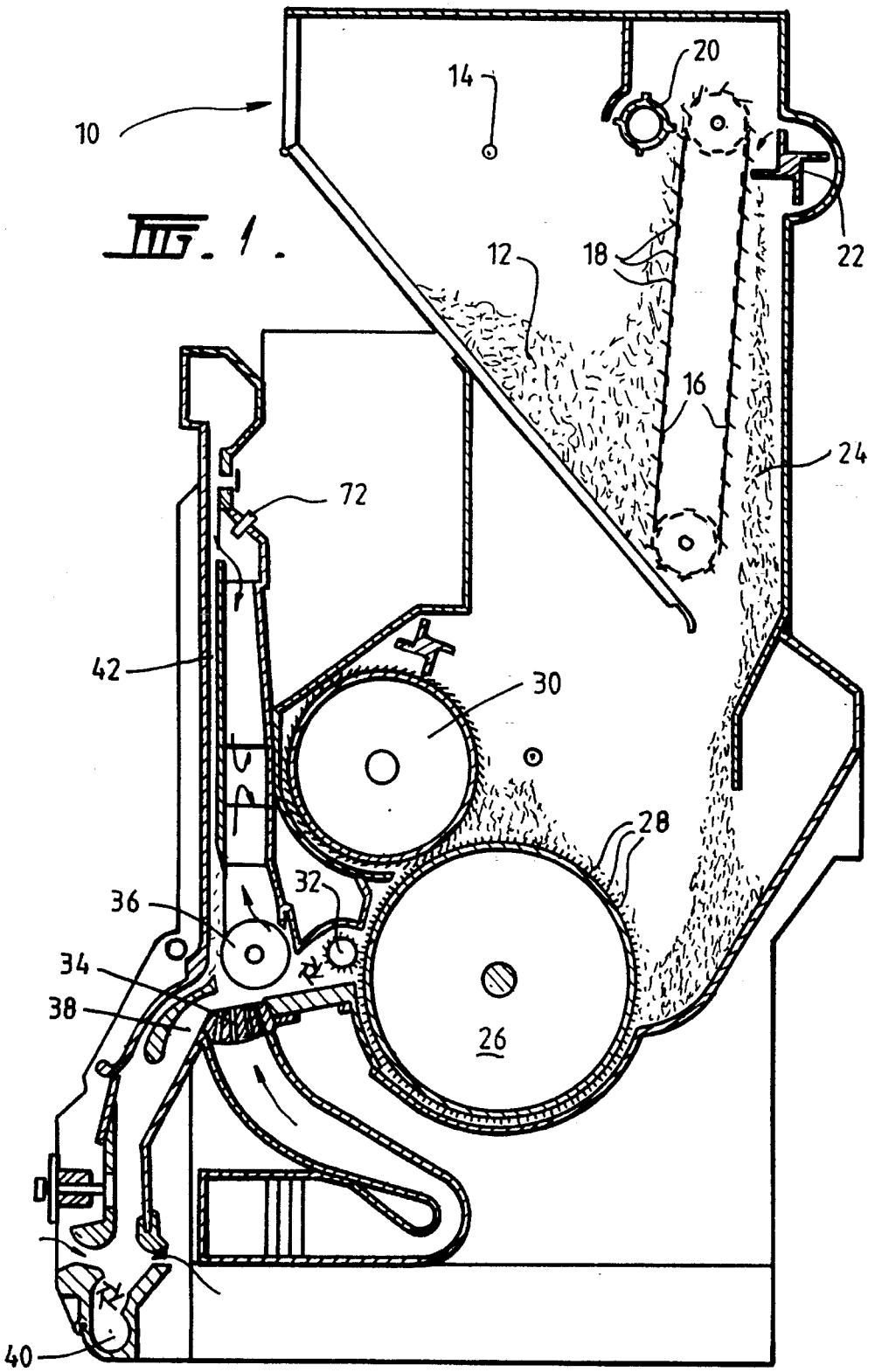
FIG. 1 is a sectional view through a hopper of a Molins MK-9 cigarette maker.

In FIG. 1 the numeral 10 denotes a predistributor hopper containing cut tobacco 12. Level sensor 14 in combination with a speed control of steep-angle conveyor 16 keeps the level of tobacco below a predetermined maximum so that the pressure against the steep-angle conveyor 16, and consequently the amount of tobacco picked up by needles 18 is very uniform. The steep-angle conveyor continuously feeds cut tobacco past refuse roller 20 and elevator cleaner 22 into a bulking chute 24. A carded drum 26 armed with needles 28 at the downstream end of bulk chute 24 picks up the cut tobacco at a uniform rate thereby generating a continuous flow of tobacco. Counter-rotating smaller carded drum 30 thins out the layer of cut tobacco on the surface of carded drum 26. A relatively fast rotating picker-roller 32 combs the tobacco off the surface of the carded drum 26 and projects it into an upwardly directed fast moving air stream generated by air passing through jet plate or block 34. Rotating collector tube 36 supports the upward acceleration of the cut tobacco. Winnowers are separated out of the air stream because of differences in ratio of particle mass to aerodynamic resistance. Further separation occurs in floatation chamber 38 with the winnowers falling into spill pipe 40. The tobacco particles are accelerated up chimney 42 to a permeable rod conveyor belt of the cigarette forming part of the maker. Except for thermocouple 72 discussed below, FIG. 1 shows a hopper unmodified according to the present invention.

Figure 2:
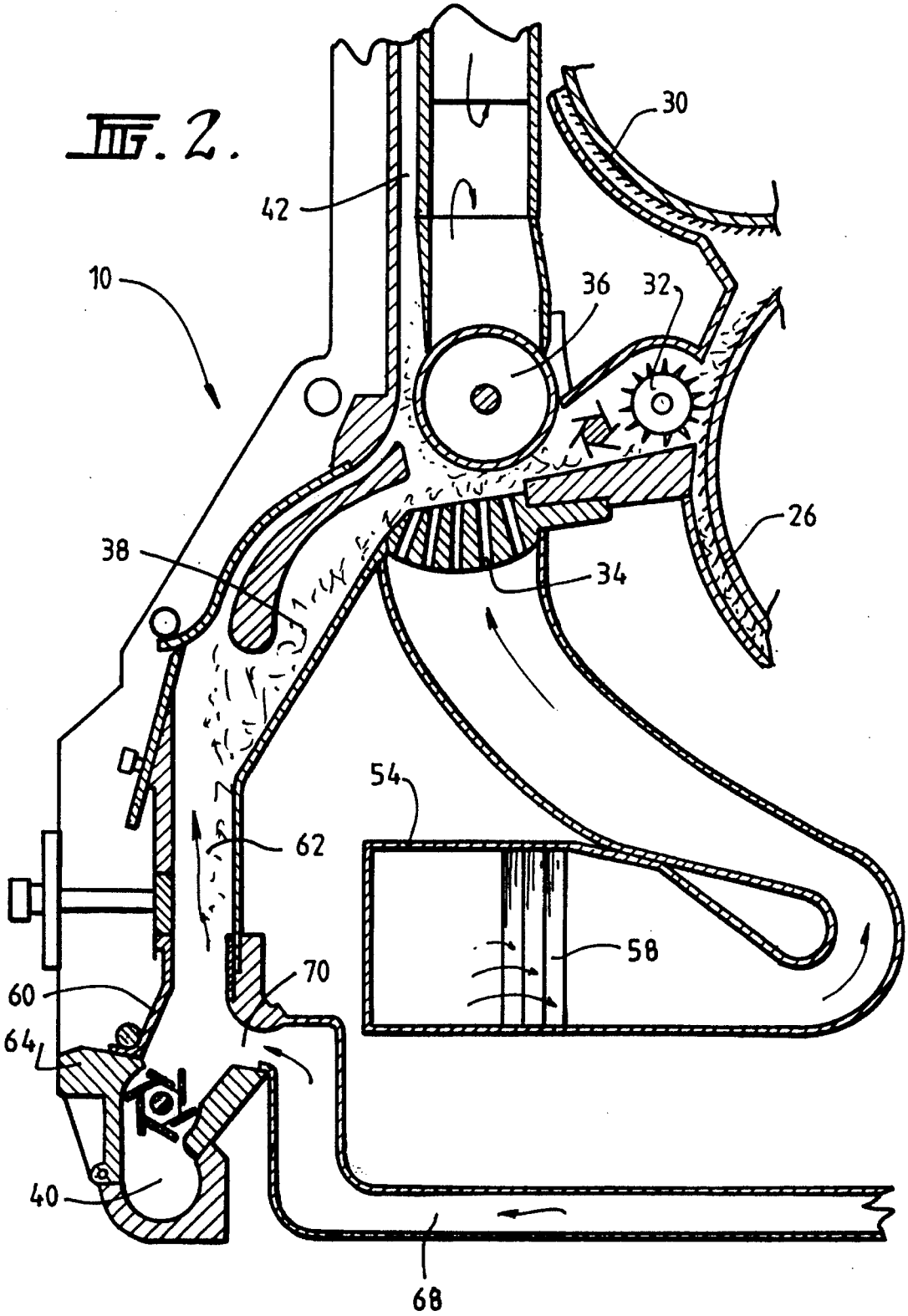
FIG. 2 is a sectional view through a portion of the hopper of a Molins MK-9 cigarette maker modified according to the present invention.
Figure 3:
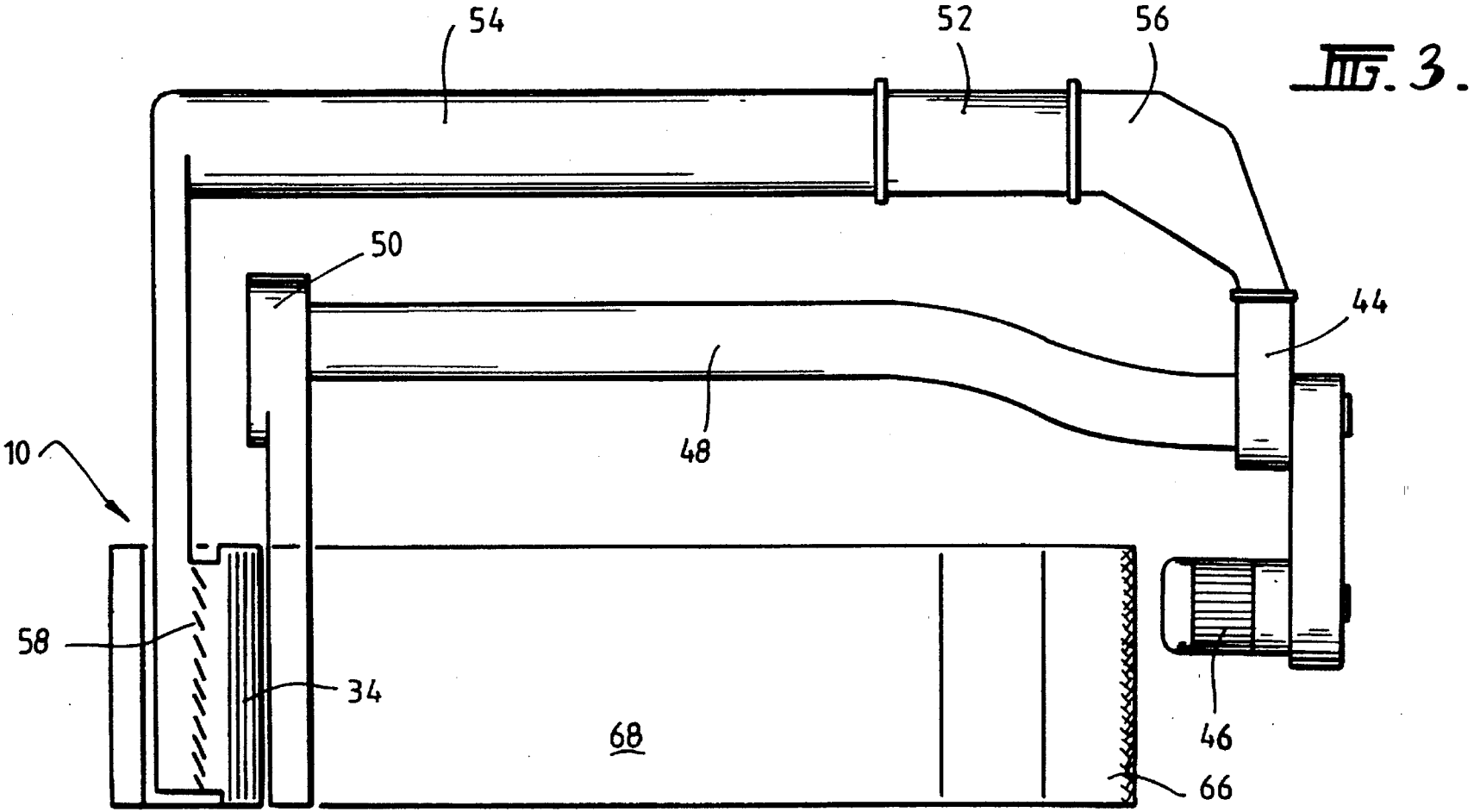
FIG. 3 is a schematic diagram of the pipeline of the small fan circuit of a Molins MK-9 cigarette maker modified according to the present invention.
Figure 4:
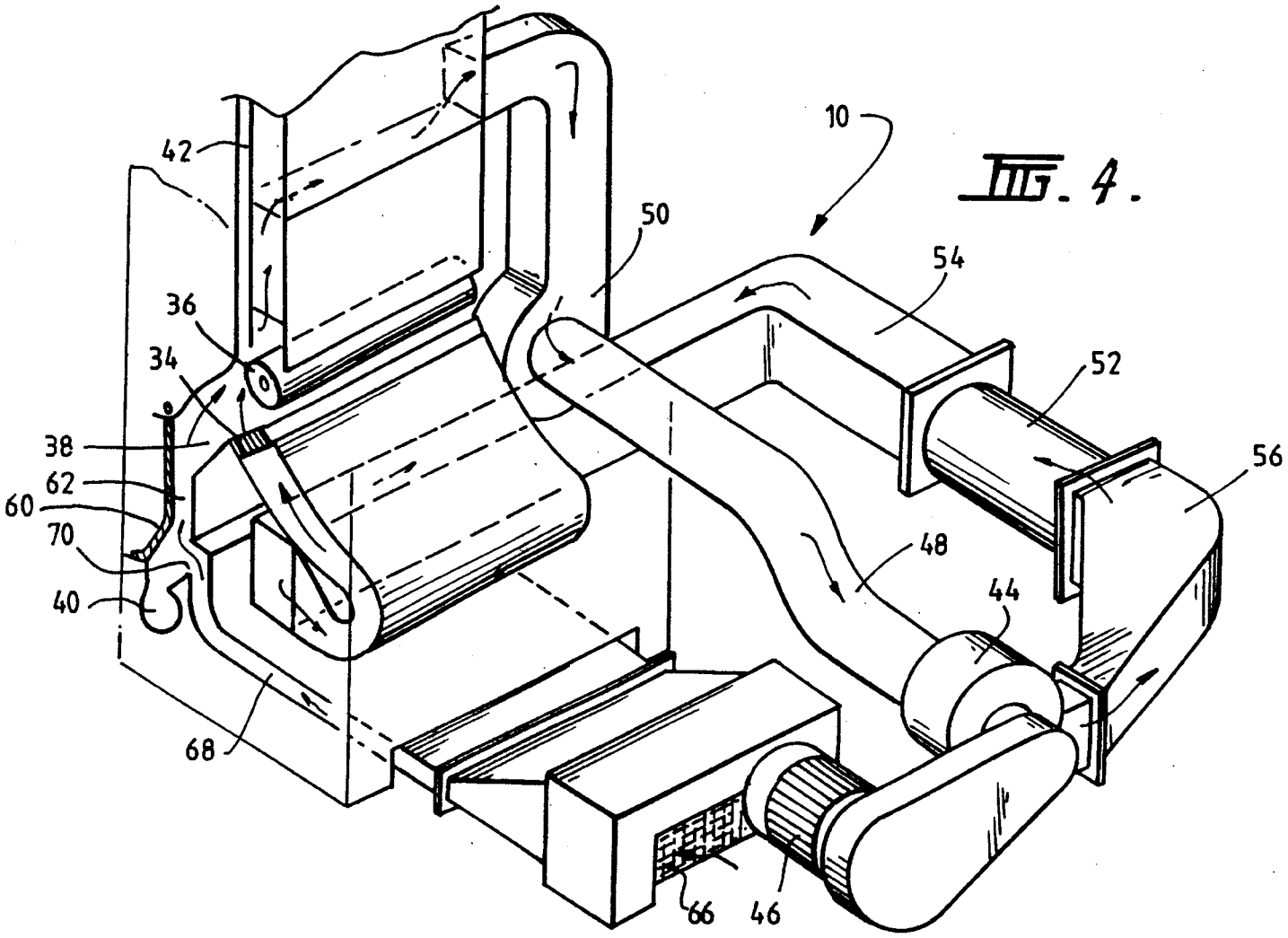
FIG. 4 shows a partially phantom rear perspective view of the hopper and small fan circuit of a Molins MK-9 cigarette maker modified according to the present invention.

The present invention is shown in greater detail in FIGS. 2–4 and comprises the forming of cigarettes from tobacco filler which is at a temperature in excess of 35° Celsius and having an elevated moisture content. According to one aspect of the invention, particles of tobacco filler having a moisture content of up to approximately 17% are heated by being exposed to a source of heat having a temperature of between approximately 35° and approximately 60° Celsius before being formed into tobacco rods. Conventional cigarette making uses tobacco having a moisture content of no greater than approximately 12.4% in the hopper. The present invention permits a moisture content of up to approximately 17% and preferably the moisture content is between approximately 13.5% and approximately 17% employing the temperature range of 35° to 60° Celsius. Preferably a temperature range of between approximately 43° and approximately 52° Celsius is employed. The heating source may be selected from infrared radiation sources, hot water jackets, heating coils, microwave radiation sources or air heated by any one or more of the foregoing. It is noted that the heat transfer between the heat source, the air, and the tobacco is very rapid and thus the described temperature of one of the foregoing is effectively the temperature of the remaining two. The heating process may take place during the acceleration of the tobacco filler particles from the distributor up to the permeable rod conveyor belt or from the tobacco feeding system supplying the distributor.

Modification of the cigarette maker to put the invention into effect includes removing the standard and small fan 44 and small fan motor 46 from within the confines of the making machine and relocating them to the rear of the machine, as shown in FIG. 3. The fan speed is increased by using different pulleys. Ducting 48, incorporating sliding joints to allow for variation between machines, is installed between fan 44 and dust separator 50.

A heat exchanger 52 is interposed in existing ducting 54 between the small fan 44 and the floatation chamber 38 at a 90° bend 56. The heating means may comprise or may be selected from infrared radiation sources, hot water jackets, heating coils, microwave radiation sources or air heated by any one or more of the foregoing. Preferably the heating means is heated air fed into the pneumatic conveying system either prior to entry of the tobacco filler into the cigarette maker or prior to the making of the tobacco rod. The heating means to heat tobacco filler particles is provided prior to the making of cigarettes.

The plastic air diffuser in jet plate 34 is replaced by a stainless steel diffuser 58 to prevent warping. Air, after heating in heat exchanger 52, passes along ducting 54 to the stainless steel diffuser 58 from whence it is diverted evenly up the chimney door after passing through jet block 34. The tobacco particles are heated whilst being transported over the jet block 34 and within the floatation chamber 38. Return air goes through ducting 48 connected to chimney 42 at an upper portion prior to the conveyor belt, via dust separator 50, to small fan 44 thus completing the closed loop. The dust separator 50 performs the same functions as in an unmodified cigarette maker.

The temperature of the air stream after heating of the tobacco has occurred is measured by a thermocouple 72, shown in FIG. 1, at the top of chimney 42. The temperature is monitored by a Eurotherm control device located at the maker control panel (not shown) and which also activates a motorized, three-way mixing valve in the pipes (not shown) which supply water to the heat exchanger 52. The water temperature in the heat exchanger 52 is maintained at a substantially constant approximately 82° Celsius by means of a boiler system (not shown). With water flow controlled and air speed substantially constant, the heat exchanger 52 maintains air temperature in the ducting 22 at between approximately 35° Celsius and approximately 50° Celsius.

In the floatation chamber 38, a cover plate 60 is fitted to the front of the chamber, allowing a two to eight millimeter adjustable gap 62 for air entry. Cover plate 60 can be any clear plastic or glass such as Perspex™ brand acrylic plastic available from Imperial Chemical Industries. An aluminum strengthening bar 64 is used at the base of the cover to prevent warping. As shown in FIGS. 3 and 4, heated air to the floatation chamber 38 is drawn through a heating coil 66 located at the rear of the machine and through a 50 millimeter by 600 millimeter duct 68 located under the machine. The hot water supplied to the heating coil 66 is connected in series to the heat exchanger 52. Tobacco stem is extracted to the central dust system after separation in the floatation chamber 38. As in the standard MK-9 making machine, the object of the floatation chamber is to remove overlarge stem pieces from the tobacco mix. For the process of the invention, the temperature of the air drawn into the floatation chamber 38 is increased by a six row heating coil 66. This heating coil 66 provides even heat transfer from aluminum fins within the casing. Hot water flow rate through the coil 66 is the same as for the heat exchanger 52. Variations in inlet temperature are slight, as the air is drawn into the chamber at a low velocity. Stem extraction to the central system is via a spill pipe 40, which is installed as a kit and passes under the machine. Air temperature in chimney 42 is dependent on the floatation chamber setting. An enlarged rear vent 70 is provided to direct air flow and stop tobacco entering the spill pipe and dust extraction system.

A motor driven mixing valve is used to proportion water to the heat exchanger 52. With velocity held constant by the fan, air passing through can be controlled to approximately ±1° Celsius. Temperature is sensed at the chimney exit by a PT100 thermalcouple 72 and a Eurotherm type 818 controller, both available from Eurotherm International Pty. Ltd. may be used to adjust the three way mixing valve in the water supply. Flow to the system may be stopped either by turning off the control or manually controlling the valve. The Eurotherm device may incorporate preset alarms which can be used to shut down the making machine should water temperature be outside pre-defined upper and lower limits.

The making of cigarettes from tobacco fibers heated in this way has been found to result in reduced degradation of the tobacco during transport and reduced degradation within the cigarette maker. The first effect arises because the employment of an elevated temperature during cigarette making increases the moisture loss during the transport of tobacco material between the hopper and the cigarette maker. To produce cigarettes at a fixed final moisture content, the initial moisture content in the cut filler must be higher than would be the case were the tobacco to be at a lower temperature. This increase in moisture content is believed to result in better resistance to degradation during mechanical and pneumatic handling. Previously, attempts to produce cigarettes using cut filler at ambient temperature and having a high moisture content resulted in inferior products. A second effect arises from the imparting of a false order to the tobacco particles due to the heating itself, which contributes to increased pliability of the tobacco particles, which in turn has the effect of potentially reducing degradation during the cigarette making process.

Further, the filling power of the tobacco particles is increased. This leads to the achievement of lower packing densities. Experimental investigations have shown that warm tobacco packs less densely than cool tobacco. It may be expected from this that tobacco, when processed at an elevated temperature and held to a controlled cigarette density, would yield firmer cigarettes than would be possible at the standard working temperature.

It has been observed that finished cigarettes are hotter than normal and a cooling period or process prior to packing is required.

It is believed that the invention and many of its attendant advantages will be understood from the foregoing description and it will be apparent that various changes may be made in the form, construction and arrangement of apparatus for carrying out the invention and that changes may be made in the form, construction and arrangement of the apparatus described without departing from the spirit and the scope of the invention or sacrificing any of its material advantages, the apparatus hereinbefore described being merely preferred embodiments for carrying out the invention.

We claim:

1. An apparatus for preparing tobacco comprising:

means for supplying tobacco;

means for separating supplied tobacco into fibers;

means for conveying the separated tobacco fibers to a tobacco rod former;

a heat source for heating the separated tobacco fibers prior to said conveying means conveying the separated tobacco fibers to the rod former;

a flotation chamber in fluid communication with said supplying means and said conveying means;

means for winnowing undesired components from the separated tobacco fibers in said flotation chamber before the undesired components are conveyed to the rod former; and first ducting for directing heated air from said heat source to said flotation chamber to heat tobacco fibers therein.

2. The apparatus according to claim 1, wherein said tobacco supplying means supplies tobacco having a moisture content greater than approximately 12.4%.

3. The apparatus according to claim 1, wherein said tobacco supplying means supplies tobacco having a moisture content up to approximately 17%.

4. The apparatus according to claim 1, wherein said heat source heats the separated tobacco fibers to a temperature greater than approximately 35° C.

5. The apparatus according to claim 1, wherein said heat source has a temperature between approximately 35° C. and approximately 60° C.

6. The apparatus according to claim 5, wherein said tobacco supplying means supplies tobacco having a moisture content between approximately 13.5% and approximately 17%.

7. The apparatus according to claim 1, wherein said heat source has a temperature between approximately 43° C. and approximately 52° C.

8. The apparatus according to claim 7, wherein said tobacco supplying means supplies tobacco having a moisture content between approximately 13.5% and approximately 17%.

9. The apparatus according to claim 1, wherein said conveying means comprises a pneumatic chimney providing driven air conveying the separated tobacco fibers, further comprising second ducting for directing the heated air from the heat source to the driven air of said pneumatic chimney conveying the separated tobacco fibers to heat the tobacco fibers.

10. The apparatus according to claim 9, wherein said second ducting for directing the heated air comprises ducting leading from said heat source to said pneumatic chimney at a location where the separated fibers are initially conveyed by driven air of said pneumatic chimney.

11. The apparatus according to claim 10, wherein said conveying means further comprises a fan providing the driven air to the pneumatic chimney, said fan driving air past said heat source to be heated and to the pneumatic chimney via said second ducting.

12. The apparatus according to claim 9, wherein said heat source heats the directed air between approximately 35° C. and approximately 50° C.

13. The apparatus according to claim 9, further comprising third ducting for directing air to said heat source, wherein said third ducting is in fluid communication with said pneumatic chimney, whereby a closed air loop is formed.

14. The apparatus according to claim 13, wherein said pneumatic chimney conveys the heated tobacco fibers upward to a conveyor belt, wherein said third ducting for directing air to said heat source is in fluid communication with said pneumatic chimney at an upper portion of said chimney prior to the conveyor belt.

15. The apparatus according to claim 9, wherein said conveying means further comprises a fan providing the driven air to the pneumatic chimney, said fan driving air past said heat source to be heated and to the pneumatic chimney via said second ducting.

16. The apparatus according to claim 9, wherein said heat source comprises a first heater for heating air driven to said pneumatic chimney and a second heater for heating air driven to said floatation chamber.

17. The apparatus according to claim 1, wherein said heat source is a heat exchanger containing heated water.

18. The apparatus according to claim 17, wherein the heated water is approximately 82° C.

19. The apparatus according to claim 1, further comprising a controller for controlling the temperature of said heat source.

20. The apparatus according to claim 1, wherein said conveying means comprises a fan providing driven air to convey the tobacco fibers.

21. The apparatus according to claim 1, wherein said heat source comprises a heating coil.

22. The apparatus according to claim 1, further comprising means for varying a volume of said flotation chamber, said volume varying means varying a temperature of heated air to heat tobacco fibers therein.

23. The apparatus according to claim 1, wherein said tobacco supplying means supplies tobacco having a moisture content greater than approximately 13.5%.

24. The apparatus according to claim 1, wherein said tobacco supplying means supplies tobacco having a moisture content between approximately 13.5% and approximately 17%.

25. A method of preparing tobacco comprising the steps of:

providing to a pneumatic chimney a supply of tobacco fibershaving an elevated moisture content of greater than approximately 12.4%;

pneumatically conveying the supply of tobacco fibers through the pneumatic chimney to a tobacco rod former via driven air; and heating the tobacco fibers in the pneumatic chimney to a temperature greater than approximately 35° C. prior to arrival at the tobacco rod former.

26. The method according to claim 25, wherein said providing step comprises providing tobacco having a moisture content up to approximately 17%.

27. The method according to claim 25, wherein said heating step comprises heating the tobacco fibers to a temperature between approximately 35° C. and approximately 65° C.

28. The method according to claim 25, wherein said heating step comprises heating the tobacco fibers to a temperature between approximately 43° C. and approximately 52° C.

29. The method according to claim 25, wherein said heating step comprises heating the driven air between approximately 35° C. and approximately 50° C.

30. The method according to claim 8, wherein said providing step comprises providing tobacco having a moisture content greater than approximately 13.5%.

31. The method according to claim 30 wherein said heating step comprises heating the tobacco fibers to a temperature between approximately 35° C. and approximately 65° C.

32. The method according to claim 25, wherein said providing step comprises providing tobacco having a moisture content between approximately 13.5% and approximately 17%.

33. The method according to claim 32 wherein said heating step comprises heating the tobacco fibers to a temperature between approximately 35° C. and approximately 65° C.

34. The method according to claim 32 wherein said heating step comprises heating the tobacco fibers to a temperature between approximately 35° C. and approximately 50° C.

35. An apparatus for preparing tobacco comprising:

means for supplying tobacco, said tobacco supplying means supplying tobacco having a moisture content greater than approximately 12.4%;

means for separating supplied tobacco into fibers;

means for conveying the separated tobacco fibers to a tobacco rod former, said conveying means comprising a pneumatic chimney having an upper aperture communicating directly with the tobacco rod former; and a heat source for heating the separated tobacco fibers in said pneumatic chimney prior to said conveying means conveying the separated tobacco fibers to the rod former at the upper aperture, wherein said heat source heats the separated tobacco fibers to a temperature greater than approximately 35° C.

36. The apparatus according to claim 35, wherein said tobacco supplying means supplies tobacco having a moisture content up to approximately 17%.

37. The apparatus according to claim 35, wherein said heat source has a temperature between approximately 35° C. and approximately 60° C.

38. The apparatus according to claim 35, wherein said heat source has a temperature between approximately 43° C. and approximately 52° C.

39. The apparatus according to claim 35, further comprising first ducting for directing air to said heat source to be heated and second ducting for directing the heated air from the heat source to the driven air of said pneumatic chimney conveying the separated tobacco fibers to heat the tobacco fibers.

40. The apparatus according to claim 39, wherein said second ducting for directing the heated air comprises ducting leading from said heat source to said pneumatic chimney at a location where the separated fibers are initially conveyed by driven air of said pneumatic chimney.

41. The apparatus according to claim 39 further comprising a fan providing the driven air to the pneumatic chimney, said fan driving air past said heat source to be heated to the pneumatic chimney via said second ducting.

42. The apparatus according to claim 39, wherein said first ducting for directing air to said heat source is in fluid communication with said pneumatic chimney, whereby a closed air loop is formed.

43. The apparatus according to claim 42, wherein said pneumatic chimney conveys the heated tobacco fibers upward to a conveyor belt, wherein said first ducting for directing air to said heat source is in fluid communication with said pneumatic chimney at an upper portion of said chimney prior to the conveyor belt.

44. The apparatus according to claim 35, wherein said heat source heats the driven air between approximately 35° C. and approximately 50° C.

45. The apparatus according to claim 35, wherein said heat source is a heat exchanger.

46. The apparatus according to claim 35, further comprising a controller for controlling the temperature of said heat source.

47. The apparatus according to claim 35, further comprising a flotation chamber in fluid communication with said supplying means and said conveying means, means for winnowing undesired components from the separated tobacco fibers in said flotation chamber before the undesired components are conveyed to the rod former, and ducting for directing heated air from said heat source to said flotation chamber to heat tobacco fibers therein.

48. The apparatus according to claim 47, wherein said heating source comprises a first heater for heating air driven to said pneumatic chimney and a second heater for heating air driven to said flotation chamber.

49. The apparatus according to claim 47, wherein said heat source comprises a heating coil.

50. The apparatus according to claim 47, further comprising means for varying a volume of said flotation chamber, said volume varying means varying a temperature of heated air to heat tobacco fibers therein.

51. The apparatus according to claim 35, wherein said tobacco supplying means supplies tobacco having a moisture content greater than approximately 13.5%.

52. The apparatus according to claim 35, wherein said tobacco supplying means supplies tobacco having a moisture content between approximately 13.5% and approximately 17%.

* * * * *